US006375507B1

(12) United States Patent
Van Koetsem et al.

(10) Patent No.: US 6,375,507 B1
(45) Date of Patent: Apr. 23, 2002

(54) CONNECTOR AND METHOD FOR MANUFACTURING A CONNECTOR

(75) Inventors: Jan Peter Karel Van Koetsem, Zwijndrecht; Gert Droesbeke, Nijlen; Luc Van den Torren, Bonheiden, all of (BE)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/338,958

(22) Filed: Jun. 24, 1999

(30) Foreign Application Priority Data

Jun. 30, 1998 (NL) ..... 1009531

(51) Int. Cl.[7] ..... H01R 13/648
(52) U.S. Cl. ..... 439/608; 439/701
(58) Field of Search ..... 439/608, 595, 439/701, 78, 598

(56) References Cited

U.S. PATENT DOCUMENTS

| | | | | |
|---|---|---|---|---|
| 3,440,596 A | * | 4/1969 | Frompovicz | 439/595 |
| 3,710,285 A | * | 1/1973 | Schor et al. | 439/608 |
| 3,774,142 A | | 11/1973 | Siegler | 339/14 R |
| 4,836,791 A | * | 6/1989 | Grabbe et al. | 439/79 |
| 5,356,301 A | | 10/1994 | Champion et al. | 439/108 |
| 5,647,768 A | | 7/1997 | Messuri et al. | 439/620 |
| 5,980,271 A | * | 11/1999 | MacDougall et al. | 439/78 |

FOREIGN PATENT DOCUMENTS

| | | |
|---|---|---|
| EP | 0273589 A1 | 7/1988 |
| EP | 0693795 A1 | 1/1996 |
| FR | 2 693 845 | 1/1994 |

* cited by examiner

*Primary Examiner*—Tulsidas Patel
(74) *Attorney, Agent, or Firm*—Perman & Green, LLP

(57) ABSTRACT

A connector for high frequency signals comprises a housing of insulating material and a plurality of male contact elements. The housing has a bottom and two opposite side walls extending upwardly from the bottom, the bottom and side walls determining a receiving space. The bottom is provided with cavities regularly arranged in rows and columns. Each of the contact elements is mounted in a cavity, an upper end of each contact element projecting into the receiving space. The bottom of the housing comprises first and second bottom parts, wherein the cavities extend through both bottom parts. At least a plurality of the cavities have a first stop in the first bottom part and a second stop in the second bottom part, wherein the first and second stops determine a mounting chamber. The contact elements are mounted in the cavities by means of at least one support element clampingly received between the first and second stops in the corresponding mounting chamber. The surface of the housing is completely metalized. At least a number of cavities are made to receive two contact elements. Each of said number of cavities is provided with two first and two second stops cooperating with the support elements of the two contact elements mounted in the cavity.

16 Claims, 6 Drawing Sheets

CONNECTOR AND METHOD FOR MANUFACTURING A CONNECTOR

The invention relates to a connector for high frequency signals, comprising a housing of insulating material and a plurality of male contact elements, said housing having a bottom and two opposite side walls extending upwardly from the bottom, the bottom and side walls determining a receiving space, wherein the bottom is provided with cavities regularly arranged in rows and columns, wherein each of the contact elements is mounted in a cavity, an upper end of each contact element projecting into the receiving space, and further relates to a method for manufacturing a connector.

In a connector of the above-mentioned type the contact elements are mounted in the housing by inserting the contact elements into the cavities and the contact elements are fixed by deforming the material of the housing. Further, it is known to use a number of the male contact elements as ground contact elements to provide a shielding for the signal contact elements. In this manner the number of contact elements which can be used as signal contact elements significantly decreases so that the signal density of the connector is relatively low.

The invention aims to provide an improved connector of the above-mentioned type which can be made in different embodiments without complicating the manufacturing.

To this end the connector according to the invention is characterized in that the bottom of the housing comprises first and second bottom parts, wherein the cavities extend through both bottom parts, wherein at least a plurality of said cavities have a first stop in the first bottom part and a second stop in the second bottom part, said first and second stops determining a mounting chamber, wherein the contact elements are mounted in the cavities by means of at least one support element clampingly received between the first and second stops in the corresponding mounting chamber.

In this manner a connector is obtained wherein the connector can be made in different embodiments by varying the design of the second bottom part and contact elements only. During manufacturing only minor forces are exerted on the contact elements so that deformation of the contact elements due to high insertion forces during manufacturing is avoided with certainty. Further, a stable fixation of the contact elements by means of their support elements clampingly received between the first and second stops is guaranteed.

According to a preferred embodiment at least a plurality of the cavities are metallized at their the inner walls, the support elements of the contact elements mounted in the metallized cavities being made of insulating material. In this manner signal density can be increased significantly as all contact elements can be used as signal contact elements which are surrounded by the metallization of the, inner wall of the cavity functioning as outer conductor thereby providing a shielding of the signal contact element.

The invention further provides a method for manufacturing a connector, comprising the steps of providing a housing part with a bottom and two side walls extending upwardly from the bottom part, the bottom having a plurality of cavities arranged in rows and columns, providing the cavities with first and second stops, providing a plurality of contact elements with support elements, mounting the contact elements in the cavities of the bottom by clamping the support element(s) of each contact element between the first and second stops.

The invention will be further explained by reference of the drawings in which some embodiments of the connector according to the invention are schematically shown.

Figure 2:
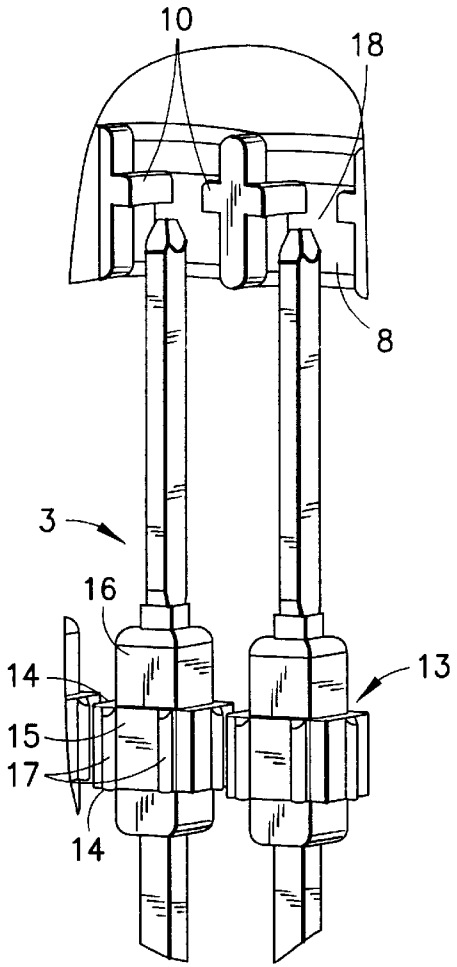
FIG. 2 shows a detail II of FIG. 1 at a larger scale.
Figure 1:
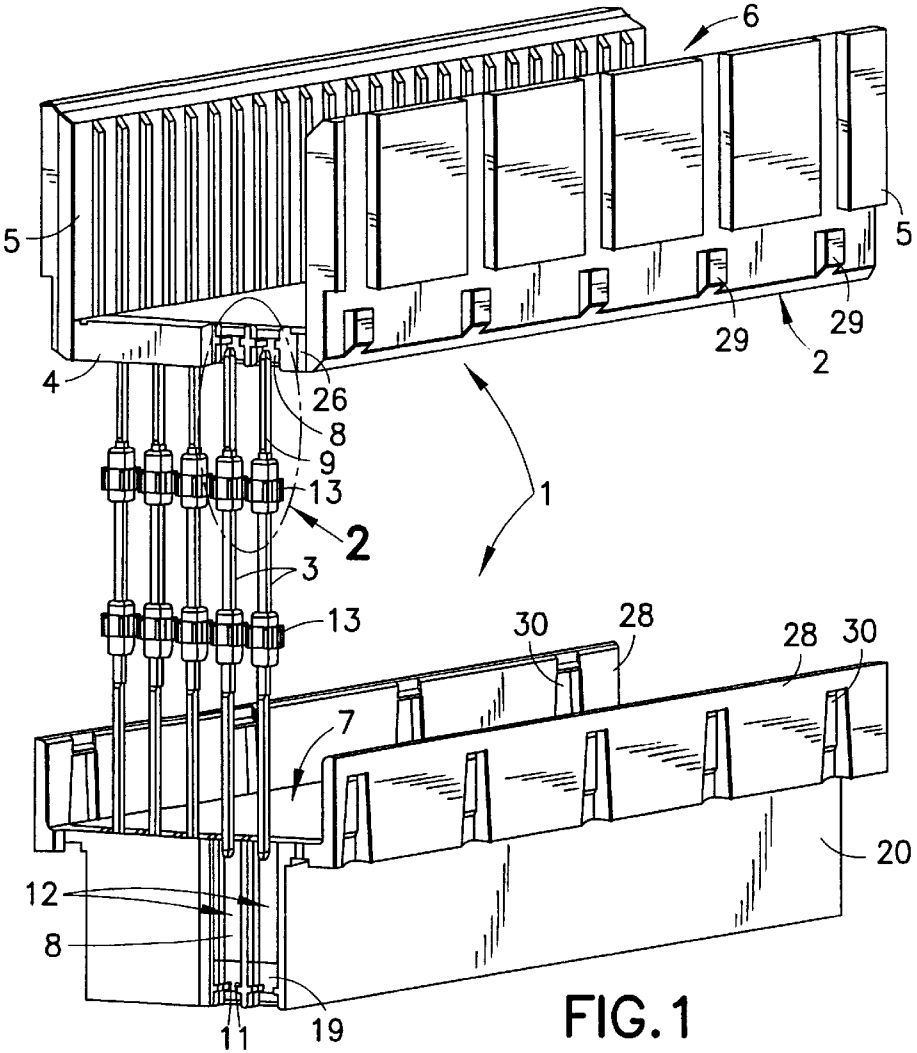
FIG. 1 shows a first embodiment of the connector according to the invention before assembly, wherein the housing is partly broken away to show the mounting of the contact elements.
Figure 3:
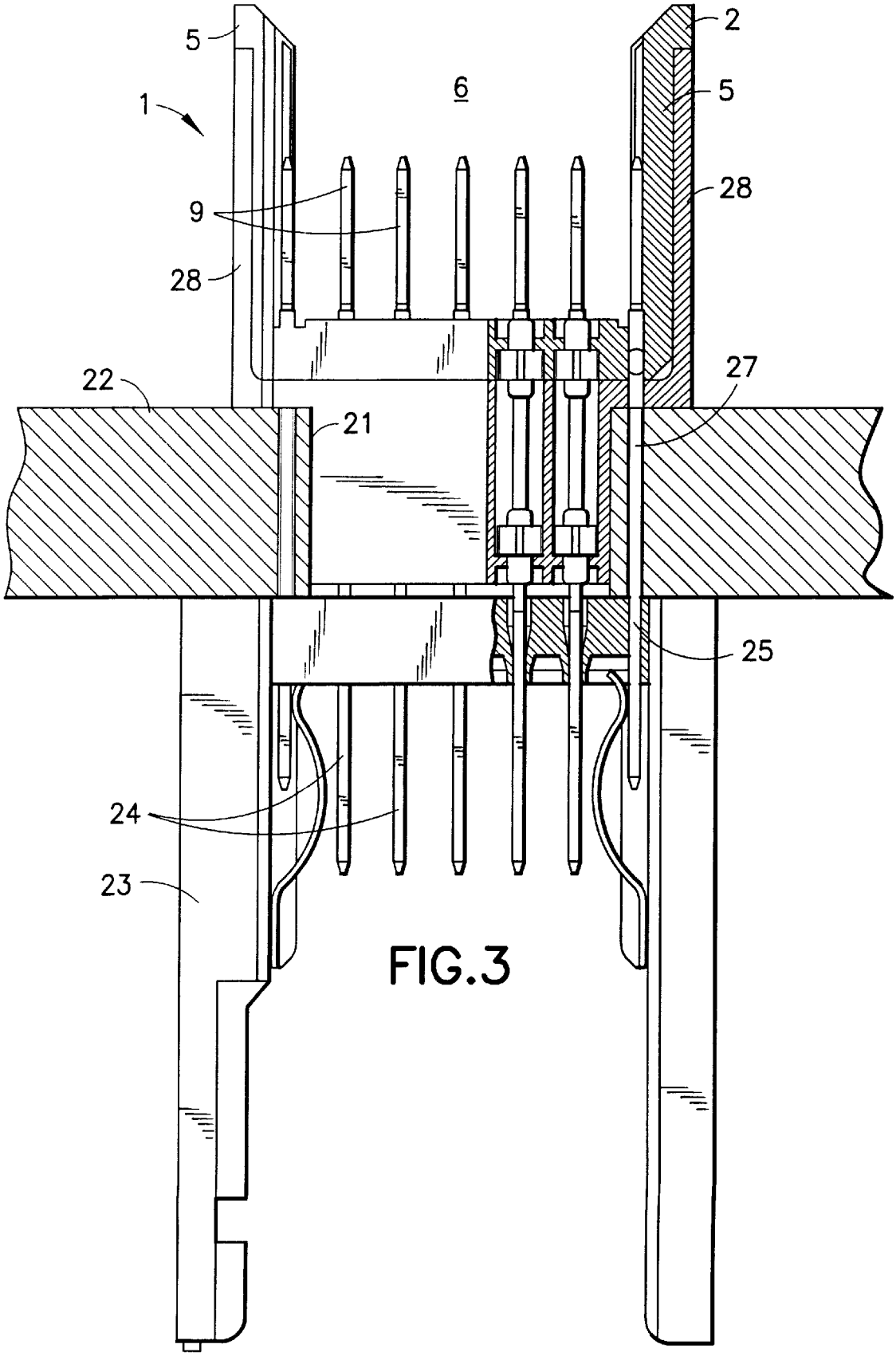
FIG. 3 shows a cross section of the connector of FIG. 1 mounted on a back panel.

FIGS. 1–3 show a connector 1 for high frequency signals, comprising a housing 2 of insulating material and a plurality of male contact elements 3 regularly arranged in rows and columns in the housing 2. In FIGS. 1–3 only a few contact elements 3 are shown for the sake of clarity. The housing 2 is provided with a first bottom part 4 and two opposite side walls 5, wherein the first bottom part 4 and the side walls 5 determine a receiving space 6. The housing 2 is further provided with a second bottom part 7, both bottom parts 4,7, providing the complete bottom of the housing 2. This bottom 4,7 is provided with cavities 8 regularly arranged in rows and columns, wherein the contact elements 3 each are mounted in a cavity, an upper end 9 of the contact elements 3 extending into the receiving space 6. In FIG. 1 only one column of cavities 8 is shown for the sake of clarity. In the embodiment shown, all cavities 8 are metallized at their inner walls as the complete housing 2 is metallized.

As can be seen in the drawings, the cavities extend through both bottom parts 4,7. In the first bottom part 4 the cavities 8 are provided with opposite ledges 10 projecting inwardly from their inner wall, which ledges 10 function as a first stop. Further, in the second bottom part 7 the cavities 8 are provided with two opposite ledges 11 projecting inwardly from their inner wall near the lower end of this bottom part 7. These ledges 11 function as a second stop. The first and second stops 10,11 determine an intermediate mounting chamber 12 as will be explained hereinafter.

For mounting the contact elements 3 in the housing 2, the contact elements 3 each are provided with two support elements 13 of insulating material. These support elements 13 are fixed on the contact elements 3 by overmoulding. To this end the contact elements 3 at the location of the support elements 13 are provided with a thickening, a projection or the like. Each support element 13 is provided with a shoulder 14 extending transverse with respect to the axial direction of the contact element 3. The shoulder 14 is provided on a body 15 of the support element 13, wherein the support element further includes a head part 16 projecting in axial direction from the shoulder 14. The body 15 is further provided with ledges 17 extending in axial direction of the contact element 3. In the embodiment shown the body has a further shoulder 14 at its other side which has no function in this case.

The section 18 of the cavities 8 in the first bottom part 4 and the section 19 of the cavities 8 in the second bottom part 7 determine an inner dimension which is smaller than the outer dimension determined by the ledges 17. The outer dimension of the body 15 is smaller than the inner dimension of the sections 18,19. Further the outer dimension determined by the ledges 17 is smaller than the inner dimension of the remaining part of the cavities 8. Finally the head part 16 of the support elements 13 can pass with a minor play the ledges 10 and 11, respectively.

For mounting the contact elements 3 in the cavities 8, the contact elements 3 are inserted into the cavities 8 of the first or second bottom part 4,7, wherein the head part 16 can pass the ledges 10 or 11, whereas the ledges 17 of the body 15 are forced into the cavity section 18 or 19, respectively. Thereafter the first and second bottom parts 4,7 are interconnected, thereby clamping the shoulders 14 of the support elements 13 between the stops 10,11. In this manner the contact elements 3 are securely and accurately mounted within the cavities 8.

The connector 1 described shows the advantage that forces exerted on the contact elements 3 are restricted to the forces required for inserting the body 15 with the ledges 17 into the cavitity sections 18 and 19, respectively. The signal density of the connector 1 is very high as all contact elements 3 can be used as signal contacts. The metallization on the inner walls of the cavities 8 functions as an outer conductor providing a complete shielding of the contact elements 3.

In the embodiment of the connector 1 of the FIGS. 1–3, the second bottom part 7 is provided with a lower extension 20 which is received in a slot 21 provided in a printed circuit board 22 as shown in FIG. 3. At the side opposite of the receiving space 6, a conventional shroud 23 can be mounted on projecting parts 24 of the contact elements 3.

At both sides of the rows of contact elements 3 a row of standard contact elements 25 is provided. These contact elements 25 are received in metallized cavities 26 and are provided with a press-fit section 27. These press-fit sections 27 are mounted in plated through holes of the printed circuit board 22. In this manner the connector 1 is fixed to the printed circuit board 22.

As clearly shown in FIG. 3, the cross section of 35 the second bottom part 7 without lower extension 20 is U-shaped, wherein the legs 28 of the second bottom part 7 engage the outer side of the side walls 5 of the housing 2. The outer side of the side walls 5 is provided with projections 29 which are received in slots 30 provided in the legs 28 of the second bottom part 7. In this manner the first and second bottom parts 4,7 are interconnected in a detachable manner.

The design of the connector 1 shown in FIGS. 1–3 provides the advantage that the connector can be adapted to a different application in an easy manner by changing the design of the second bottom part 7 and contact elements 3, for example.

Figure 5:
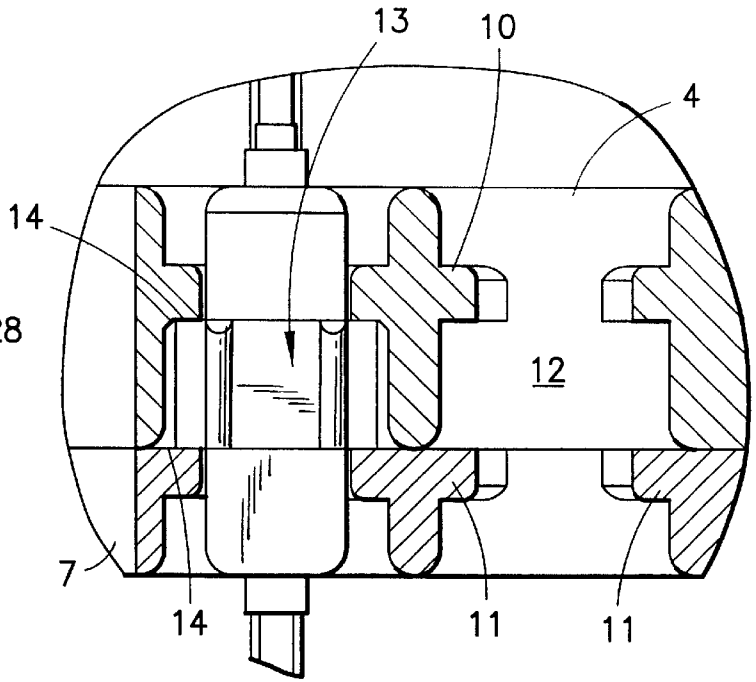
FIG. 5 shows a detail V of the connector of FIG. 1 at a larger scale.
Figure 4:
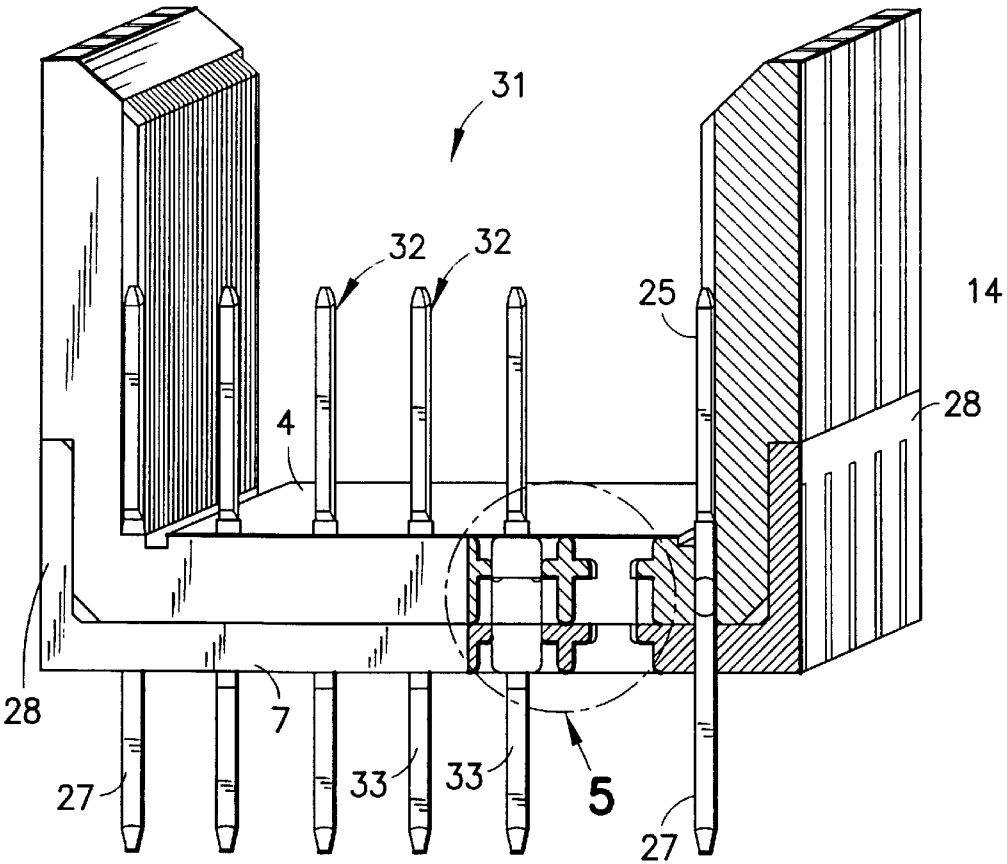
FIG. 4 shows a perspective view of a second embodiment of the connector of the invention.
Figure 6:
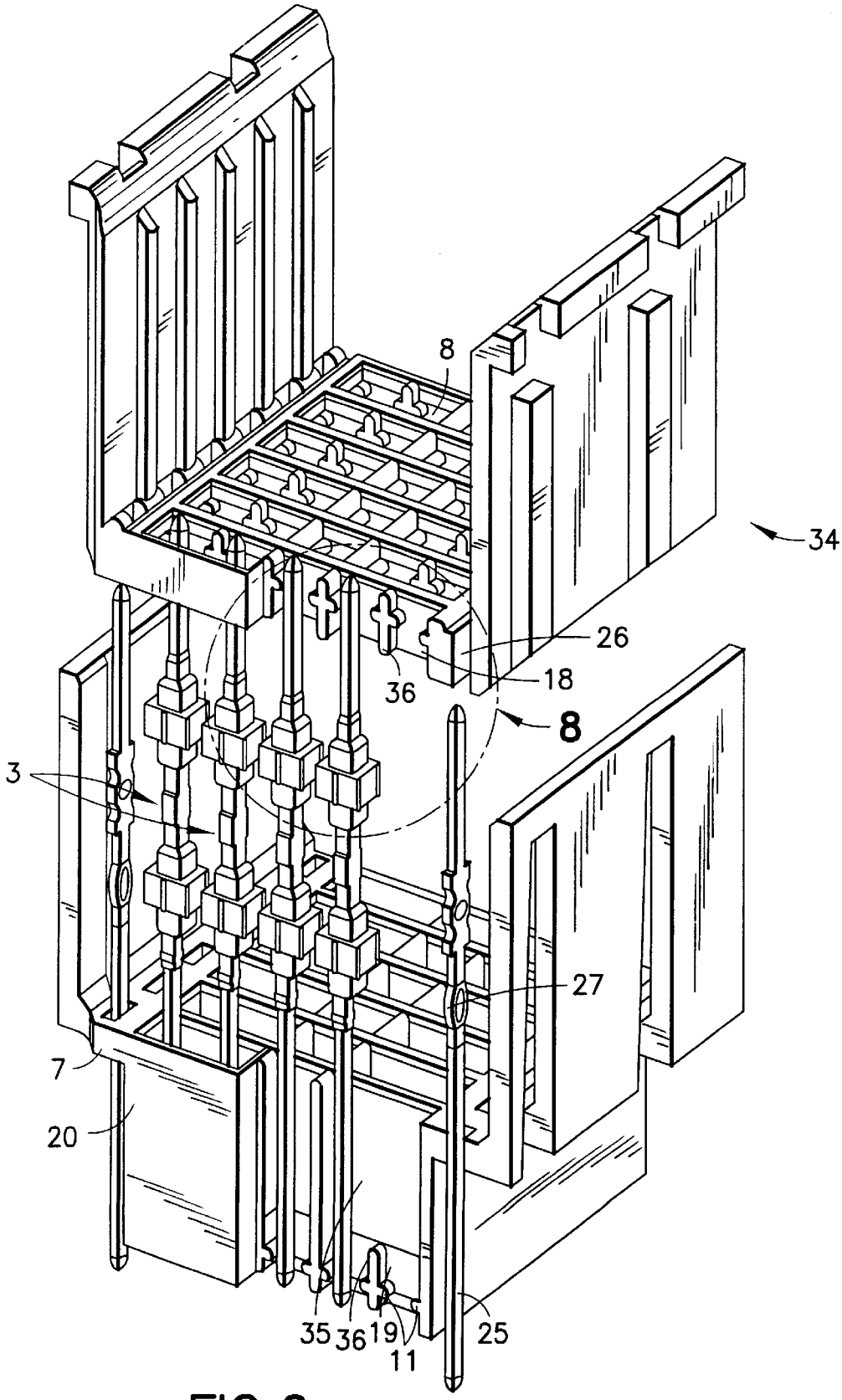
FIG. 6 shows an exploded view of a third embodiment of the connector according to the invention.
Figure 7:
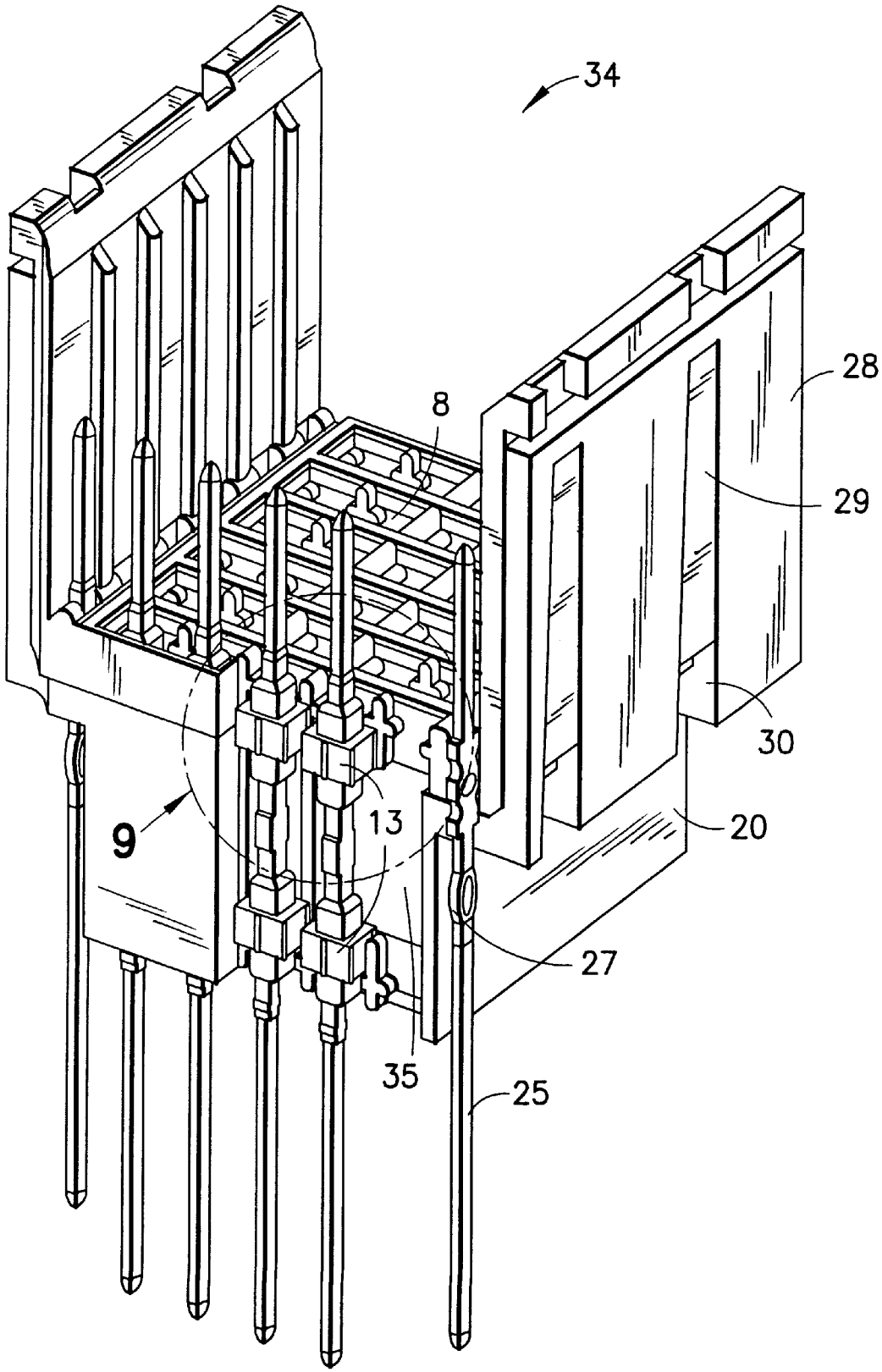
FIG. 7 shows a perspective view of the connector of FIG. 6, wherein the housing is partly broken away to show the mounting of the contact elements.
Figure 8:
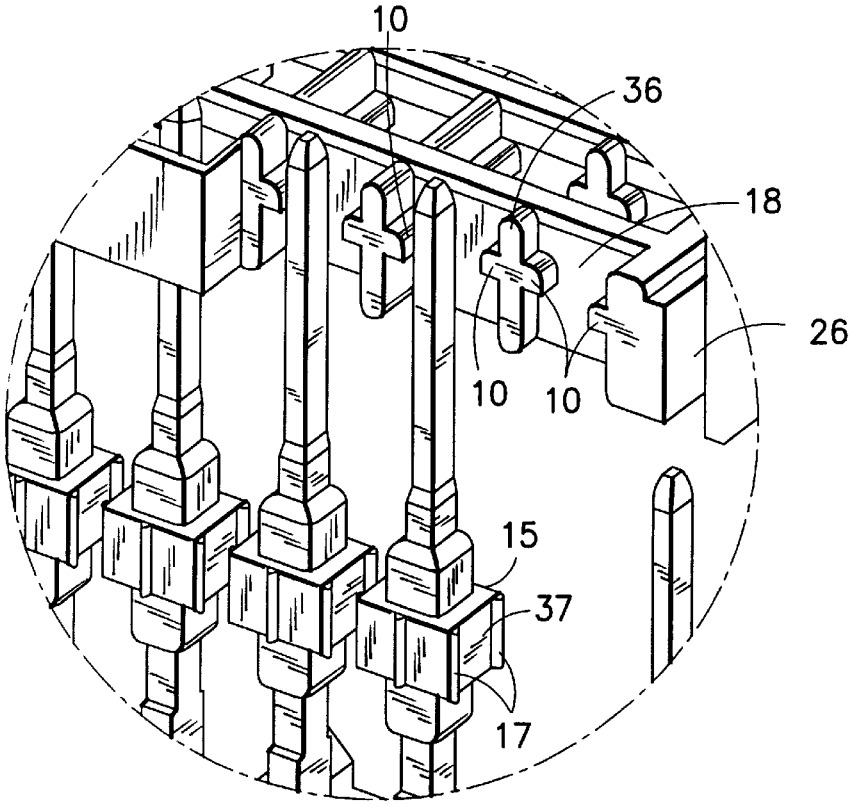
FIGS. 8 and 9 show a detail of the connector of FIG. 7 at a larger scale before and after mounting of the contact elements, respectively.
Figure 9:
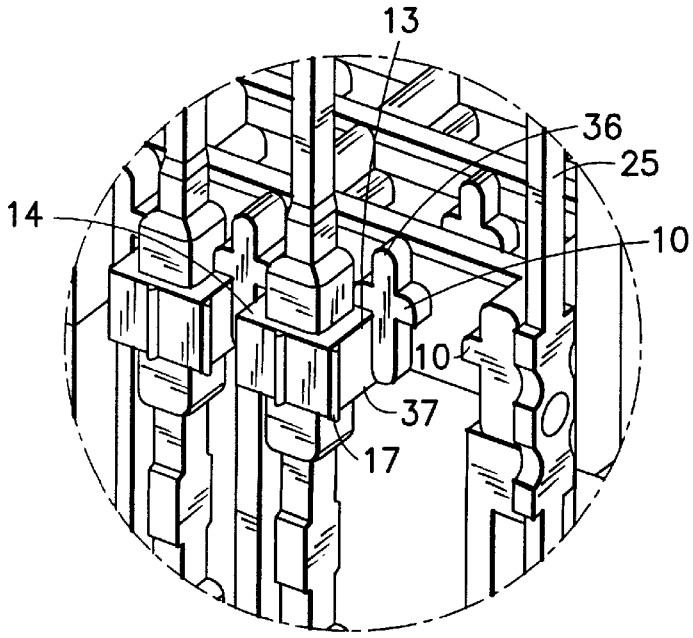

FIGS. 4 and 5 show a connector 31 which is mainly made in the same manner as the connector 1, corresponding parts being indicated by the same reference numerals. In this case the second bottom part 7 is made without the lower extension 20 and contact elements 32 are used, which are provided with one support element 13 only. In this case both shoulders 14 of the support element 13 are used to clamp the support element within the cavity 8. The head part 16 at both sides of the body 15 pass the stop ledges 10,11 in the first bottom part 4 and second bottom part 7, respectively.

Further, the contact elements 32 have a press-fit section 33 to be mounted in plated holes of a printed circuit board not further shown in the same manner as the contact elements 25 with their press fit section 27.

FIGS. 6–9 show a connector 34 mainly corresponding to the connector of FIGS. 1–3, corresponding parts being indicated by the same reference numerals. In this case the second bottom part 7 is also provided with a lower extension 20 just as in the connector 1 of FIGS. 1–3. In the connector 34 one center row of cavities 8 is provided and at each side of this center row of cavities 8 twinax cavities 35 are provided. Each twinax cavity 35 receives two contact elements 3. These contact elements 3 are mounted within the cavities 35 in the same manner as the contact elements 3 in the cavities 8. As shown at a larger scale in FIGS. 8 and 9, the cavity sections 18 and 19, respectively are provided with four ledges 10 and 11, respectively. The ledges 10,11 provided in the center of the cavities 35 have a short length in row direction only. These short ledges 10,11 are provided on short wall sections 36, which co-operate with the axial ledges 17 of the support elements 13 for fixation of the contact elements within the cavities 35. To this end the body 15 of the support elements 13 is provided with two ledges 17 at the corners of side faces 37 extending in row direction (see FIGS. 8 and 9).

It will be understood that the described manner of mounting the contact elements can be applied in various types of connectors, wherein the cavities may be metallized or not.

Therefore, the invention is not restricted to the above described embodiments which can be varied in a number of ways within the scope of the claims.

What is claimed is:

1. Connector for high frequency signals, comprising a housing of insulating material and a plurality of male contact elements, said housing having a bottom and two opposite side walls extending upwardly from the bottom, the bottom and side walls determining a receiving space, wherein the bottom is provided with cavities regularly arranged in rows and columns, wherein each of the contact elements is mounted in a cavity, an upper end of each contact element projecting into the receiving space, wherein the bottom of the housing comprises first and second bottom parts, wherein the cavities extend through both bottom parts, wherein each cavity of at least a plurality of said cavities have a first stop in the first bottom part and a second stop in the second bottom part, said first and second stops in each cavity determining a mounting chamber, wherein the contact elements are mounted in the cavities by means of at least one support element on each contact element being clamped between the first and second stops in a corresponding mounting chamber.

2. Connector according to claim 1, wherein the first and second bottom parts are interconnected in a detachable manner.

3. Connector according to claim 1, wherein the second bottom part has a U-shaped cross section, the legs of the second bottom part engaging the outer side of the side walls of the housing.

4. Connector according to claim 3, wherein the outer side of the side walls is provided with projections and the legs of the second bottom part are provided with slots cooperating with said projections for interconnecting the first and second bottom parts.

5. Connector according to claim 1, wherein the second bottom part is provided with a lower extension, the cavities extending through the complete extension, wherein each contact element is provided with two support elements, a first support being provided near the receiving space and a second support element being provided near the lower end of said extension.

6. Connector according to claim 1, wherein an inner wall of each of said plurality of cavities is provided with two pairs of opposite, inwardly protruding ledges as first and second stops and wherein each support element of a contact element is provided with a shoulder engaging the corresponding ledges.

7. Connector according to claim 6, wherein each support element is provided with a head part projecting in axial direction from the shoulder, said head part passing said inwardly protruding ledges.

8. Connector according to claim 1, wherein each support element comprises a body having an outer diameter which is smaller than the inner diameter of the corresponding cavity, and a plurality of ledges extending mainly in axial direction of the contact element and determining an outer dimension which is larger than the inner dimension of at least a part of the corresponding cavity.

9. The connector according to claim 6, wherein only the section of the cavities in the first bottom part and the lower section of the cavities in the second bottom part have an inner dimension smaller than the outer dimension determined by the inwardly protruding ledges.

10. Connector according to claim 1, wherein at least a plurality of the cavities have metallized inner walls so that the plurality of cavities are metallized cavities, the support elements of the contact elements mounted in the metallized cavities being made of insulating material.

11. Connector according to claim 1, wherein the housing has a completely metallized surface.

12. Connector according to claim 1, wherein at least a number of the cavities are made to receive two contact elements, wherein each of said number of cavities is provided with two first and two second stops cooperating with the support elements of the two contact elements mounted in such a cavity.

13. Connector according to claim 1, wherein a row of cavities is provided at each side of the rows of metallized cavities, wherein male ground contact elements are mounted in the cavities of these rows, said ground contact elements contacting the metallization in the corresponding cavities and having terminals for connection to a printed circuit board.

14. A method for manufacturing a connector, comprising the steps of providing a housing part with a bottom and two side walls extending upwardly from the bottom part, the bottom having a plurality of cavities arranged in rows and columns, providing the cavities with first and second stops, providing a plurality of contact elements with support elements which are mounted on the contact elements by overmoulding, and mounting the contact elements in the cavities of the bottom by clamping the support elements of each contact element between the first and second stops.

15. The method according to claim 14, comprising the step of providing the housing with first and second bottom parts with the cavities extending through both bottom parts, the cavities in the first bottom part having a first stop, the cavities in the second bottom part having the second stop, wherein the contact elements are mounted in the cavities of the first and second bottom parts by interconnecting said first and second bottom parts and thereby clamping the support elements of each contact element between the first and second stops.

16. Method according to claim 14, wherein the housing is provided with a completely metallized surface.

* * * * *